US006396036B1

(12) United States Patent
Hanson

(10) Patent No.: US 6,396,036 B1
(45) Date of Patent: May 28, 2002

(54) MICROWAVE PACKAGING HAVING PATTERNED ADHESIVE; AND METHODS

(75) Inventor: Denise Ellen Hanson, Elk River, MN (US)

(73) Assignee: ConAgra, Inc., Edina, MN (US)

( * ) Notice: Subject to any disclaimer, the term of this patent is extended or adjusted under 35 U.S.C. 154(b) by 0 days.

(21) Appl. No.: 09/714,342

(22) Filed: Nov. 16, 2000

Related U.S. Application Data

(60) Provisional application No. 60/166,480, filed on Nov. 19, 1999.

(51) Int. Cl.[7] ..... H05B 6/80; B65D 30/08

(52) U.S. Cl. ..... 219/727; 219/730; 426/234; 99/DIG. 14; 156/180; 156/295

(58) Field of Search ..... 219/727, 730, 219/725, 759; 426/107, 234, 243; 99/DIG. 14; 383/109–116; 156/166, 180, 181, 295, 305, 325

(56) References Cited

U.S. PATENT DOCUMENTS

| | | | |
|---|---|---|---|
| 1,765,862 | A | 6/1930 | Claff |
| 1,944,089 | A | 1/1934 | Litchfield |
| 2,041,227 | A | 5/1936 | Chalmers |
| 2,149,872 | A | 3/1939 | Schmidt |
| 2,673,805 | A | 3/1954 | Colman |
| 2,673,806 | A | 3/1954 | Colman |
| 2,741,559 | A | 4/1956 | Banowitz |
| 2,852,898 | A | 9/1958 | Berg |
| 2,858,970 | A | 11/1958 | Barnes et al. |
| 2,865,768 | A | 12/1958 | Barnes et al. |
| 3,027,261 | A | 3/1962 | Samara |
| 3,035,754 | A | 5/1962 | Meister |
| 3,052,554 | A | 9/1962 | Colman |
| 3,107,989 | A | 10/1963 | Fesco |
| 3,220,635 | A | 11/1965 | Kasting et al. |
| 3,286,832 | A | 11/1966 | Pilger |

(List continued on next page.)

*Primary Examiner*—Philip H. Leung
(74) *Attorney, Agent, or Firm*—Merchant & Gould P.C.

(57) ABSTRACT

A microwave popcorn package is provided. The package has an inner ply and an outer ply of flexible material, such as paper, with a microwave interactive construction therebetween. The plies are bonded together with a laminating adhesive that is applied in a regular pattern of polygonal adhesive areas. This pattern occupies at least 80 square inches (516 $cm^2$) of the surface between the plies, and provides no more than 50% adhesive coverage of that area where the pattern is located. The adhesive polygons can be squares or diamonds. A second adhesive pattern can be present in a second portion of the ply surface.

20 Claims, 9 Drawing Sheets

U.S. PATENT DOCUMENTS

| | | | |
|---|---|---|---|
| 3,293,048 | A | 12/1966 | Kitterman |
| 3,326,097 | A | 6/1967 | Lokey |
| 3,353,327 | A | 11/1967 | Cutler et al. |
| 3,357,152 | A | 12/1967 | Geigel |
| 3,620,834 | A | 11/1971 | Duffy |
| 3,637,132 | A | 1/1972 | Gray |
| 3,638,787 | A | 2/1972 | Bodolay et al. |
| 3,647,508 | A | 3/1972 | Gorrell |
| 3,777,447 | A | 12/1973 | Herbine et al. |
| 3,835,280 | A | 9/1974 | Gades et al. |
| 3,844,409 | A | 10/1974 | Bodolay et al. |
| 3,851,574 | A | 12/1974 | Katz et al. |
| 3,873,735 | A | 3/1975 | Chalin et al. |
| 3,956,866 | A | 5/1976 | Lattur |
| 3,970,241 | A | 7/1976 | Hanson |
| 3,973,045 | A | 8/1976 | Brandberg et al. |
| 4,036,423 | A | 7/1977 | Gordon |
| 4,038,425 | A | 7/1977 | Brandberg et al. |
| 4,043,098 | A | 8/1977 | Putnam, Jr. et al. |
| 4,077,853 | A | 3/1978 | Coll-Palagos |
| 4,118,813 | A | 10/1978 | Putnam, Jr. et al. |
| 4,132,811 | A | 1/1979 | Standing et al. |
| 4,136,505 | A | 1/1979 | Putnam, Jr. et al. |
| 4,156,806 | A | 5/1979 | Teich et al. |
| 4,171,605 | A | 10/1979 | Putnam, Jr. et al. |
| 4,184,061 | A | 1/1980 | Suzuki et al. |
| 4,190,757 | A | 2/1980 | Turpin et al. |
| 4,196,331 | A | 4/1980 | Leveckis et al. |
| 4,219,573 | A | 8/1980 | Borek |
| 4,228,945 | A | 10/1980 | Wysocki |
| 4,230,767 | A | 10/1980 | Isaka et al. |
| 4,230,924 | A | 10/1980 | Brastad et al. |
| 4,241,563 | A | 12/1980 | Müller et al. |
| 4,242,378 | A | 12/1980 | Arai |
| 4,258,086 | A | 3/1981 | Beall |
| 4,264,668 | A | 4/1981 | Balla |
| 4,267,420 | A | 5/1981 | Brastad |
| 4,279,933 | A | 7/1981 | Austin et al. |
| 4,283,427 | A | 8/1981 | Winters et al. |
| 4,291,520 | A | 9/1981 | Prince et al. |
| 4,292,332 | A | 9/1981 | McHam |
| 4,316,070 | A | 2/1982 | Prosise et al. |
| 4,324,088 | A | 4/1982 | Yamashita et al. |
| 4,335,291 | A | 6/1982 | Ishino et al. |
| 4,345,133 | A | 8/1982 | Cherney et al. |
| 4,355,757 | A | 10/1982 | Roccaforte |
| 4,389,438 | A | 6/1983 | Ohtsuki et al. |
| 4,398,944 | A | 8/1983 | Beckett |
| 4,453,665 | A | 6/1984 | Roccaforte et al. |
| 4,461,031 | A | 7/1984 | Blamer |
| 4,477,705 | A | 10/1984 | Danley et al. |
| 4,493,685 | A | 1/1985 | Blamer |
| 4,517,045 | A | 5/1985 | Beckett |
| 4,518,651 | A | 5/1985 | Wolfe, Jr. |
| 4,552,614 | A | 11/1985 | Beckett |
| 4,553,010 | A | 11/1985 | Bohrer et al. |
| 4,571,337 | A | 2/1986 | Cage et al. |
| 4,584,202 | A | 4/1986 | Roccaforte |
| 4,586,649 | A | 5/1986 | Webinger |
| 4,610,755 | A | 9/1986 | Beckett |
| 4,612,431 | A | 9/1986 | Brown et al. |
| 4,640,838 | A | 2/1987 | Isakson et al. |
| 4,641,005 | A | 2/1987 | Seiferth |
| 4,661,671 | A | 4/1987 | Maroszek |
| 4,678,882 | A | 7/1987 | Bohrer et al. |
| 4,685,997 | A | 8/1987 | Beckett |
| 4,701,585 | A | 10/1987 | Stewart |
| 4,705,927 | A | 11/1987 | Levendusky et al. |
| 4,713,510 | A | 12/1987 | Quick et al. |
| 4,727,706 | A | 3/1988 | Beer |
| 4,734,288 | A | 3/1988 | Engstrom et al. |
| 4,738,882 | A | 4/1988 | Rayford et al. |
| 4,794,005 | A | 12/1988 | Swiontek |
| 4,797,010 | A | 1/1989 | Coelho |
| 4,804,582 | A | 2/1989 | Noding et al. |
| 4,806,718 | A | 2/1989 | Seaborone et al. |
| 4,808,780 | A | 2/1989 | Seaborne |
| 4,810,845 | A | 3/1989 | Seaborne |
| 4,818,831 | A | 4/1989 | Seaborne |
| 4,825,025 | A | 4/1989 | Seiferth |
| 4,851,246 | A | 7/1989 | Maxwell et al. |
| 4,864,089 | A | 9/1989 | Tighe et al. |
| 4,864,090 | A | 9/1989 | Maxwell et al. |
| 4,883,936 | A | 11/1989 | Maynard et al. |
| 4,892,744 | A | 1/1990 | Ylvisaker |
| 4,896,009 | A | 1/1990 | Pawlowski |
| 4,904,488 | A | 2/1990 | LaBaw et al. |
| 4,914,266 | A | 4/1990 | Parks et al. |
| 4,915,780 | A | 4/1990 | Beckett |
| 4,943,456 | A | 7/1990 | Pollart et al. |
| 4,948,932 | A | 8/1990 | Clough |
| 4,959,516 | A | 9/1990 | Tighe et al. |
| 4,973,810 | A | 11/1990 | Brauner |
| 4,982,064 | A | 1/1991 | Hartman et al. |
| 5,011,299 | A | 4/1991 | Black, Jr. et al. |
| 5,038,009 | A | 8/1991 | Babbitt |
| 5,044,777 | A | 9/1991 | Watkins et al. |
| 5,081,330 | A | 1/1992 | Brandberg et al. |
| 5,095,186 | A | 3/1992 | Scott Russell et al. |
| 5,153,402 | A | 10/1992 | Quick et al. |
| 5,195,829 | A | 3/1993 | Watkins et al. |
| 5,200,590 | A | 4/1993 | Bowen et al. |
| 5,294,765 | A | 3/1994 | Archibald et al. |
| 5,298,708 | A | 3/1994 | Babu et al. |
| 5,650,084 | A | 7/1997 | Bley |
| 5,690,853 | A | 11/1997 | Jackson et al. |
| 5,753,895 | A | 5/1998 | Olson et al. |
| 5,871,790 | A | 2/1999 | Monier et al. |
| 5,928,554 | A | 7/1999 | Olson et al. |
| 6,049,072 | A | 4/2000 | Olson et al. |

MICROWAVE PACKAGING HAVING PATTERNED ADHESIVE; AND METHODS

Priority under 35 U.S.C. §119(e) is claimed to provisional application Ser. No. 60/166,480, filed Nov. 19, 1999, and entitled "Microwave Packaging Having Patterned Adhesive; and Method". The complete disclosure of application Ser. No. 60/166,480 is incorporated by reference herein.

FIELD OF THE INVENTION

The present invention relates to materials and packaging for use as expandable packaging, such as bags, for popping microwave popcorn.

BACKGROUND

Many microwave popcorn popping constructions in common commercial use are multi-ply paper bags in which inner and outer paper sheets are laminated to one another, with a microwave interactive construction (sometimes referred to as a microwave susceptor) encapsulated between the paper plies. Popcorn popping bags of this type are described, for example, in U.S. Pat. Nos. 4,904,488; 4,973,810; 4,982,064; 5,044,777; and 5,081,330, the disclosures of which are incorporated herein by reference.

A common feature of such constructions is that they are generally made from flexible paper materials. In this manner, the constructions are sufficiently flexible to open or expand conveniently under steam pressure, which forms when a popcorn charge therein is exposed to microwave energy in a microwave oven. Also, the packaging materials are sufficiently flexible to be formed from a sheet into a folded configuration, for example during a continuous bag-construction process.

Many microwave popcorn products include, within the package or bag, a charge of unpopped popcorn kernels, fat/oil (i.e., grease) and flavoring (for example salt). During storage or shipment, especially if the environment becomes relatively hot, the material stored within the bag can become liquefied and leak through the bag construction. Even when relatively high temperatures are not encountered in storage, some leakage can occur if the stored material includes a significant amount of flowable or liquefied oil/fat.

In addition, conventional microwave cooking of popcorn (especially when the popcorn charge includes fat/oil) results in the generation of hot liquid oil or fat. If the construction retaining the popcorn charge is paper, the paper must be sufficiently resistant to staining and to the passage of hot liquid oil/fat therethrough during the microwave cooking process to be satisfactory for performance of the product. For example, the oil/fat should not leak from the construction when the microwave cooking (i.e. popping) is undertaken. The construction should be sufficiently greaseproof or grease resistant so as to minimize an undesirable greasy feel or appearance on the outside of the package.

SUMMARY OF THE INVENTION

According to the present invention, a microwave popcorn package or bag is provided. The package generally comprises a flexible bag construction having inner and outer plies with the inner ply bonded to the outer ply by an adhesive present in an area as an adhesive pattern. The adhesive pattern is a pattern of polygons. Typically and preferably, the adhesive pattern is a pattern of evenly spaced filled diamonds or squares.

According to the invention, the adhesive is present as an adhesive pattern covering no more than about 50% of the surface area where the adhesive pattern is present. Typically, no more than about 40% of the area is covered, and preferably, no more than about 30% of the area is covered by adhesive. The area in which the adhesive pattern is present is at least about 80 square inches (516 $cm^2$), generally at least about 100 square inches (645 $cm^2$). Typically, the area is at least about 150 square inches (968 $cm^2$), and preferably, the area is at least 200 square inches (1290 $cm^2$). The adhesive pattern can cover the entire surface area of the ply, or the ply can have areas having a second adhesive pattern. The second adhesive pattern may be a continuous coating of adhesive, a discontinuous yet connected coating of adhesive, or may be a geometric pattern different than the major first adhesive pattern. The second adhesive pattern can be present, for example, as a perimeter border, or as a central area in which a microwave susceptor is positioned.

In one preferred embodiment, an adhesive pattern of equally spaced squares, which provides a coverage of 28%, covers the entire surface of the ply except for two areas of 3 square inches (19.4 $cm^2$) that have continuous coverage of adhesive; thus the pattern covers about 241 square inches (1555 $cm^2$). In another preferred embodiment, an adhesive pattern of equally spaced squares covers the entire surface of the ply at an adhesive coverage of about 28%.

In general, arrangements according to the present invention may be utilized to provide good effective microwave packaging, especially for popcorn, with savings over the amount of adhesive, and thus cost, utilized in many conventional arrangements.

DETAILED DESCRIPTION OF THE INVENTION

In general, conventional microwave popcorn package constructions are two-ply systems with laminating adhesive applied between the two plies. Generally the laminating adhesive is applied over the entire surface of at least one of the two plies.

One of the disadvantages with this construction is the large cost of the adhesive. Second, substantial weight is added to the packaging, which is less desirable both for shipping and cooking concerns. The additional weight increases the cost of shipping the packages, and, increased energy is needed to create the heat/steam pressure needed for expansion of the package during popping by the consumer. Also, large amounts of adhesive between the plies can add stiffness to the overall construction, potentially reducing the ability of the arrangement to puff up or expand during use.

According to the invention, instead of applying a continuous coating of adhesive to the entire region between the plies of a multi-ply bag arrangement, the adhesive is applied in a pattern that covers no more than 50% of the area to which the adhesive pattern is applied. Preferably the adhesive pattern selected provides adhesive coverage of no more than 40% of the area, more preferably no more than 30% of the area to which to the adhesive pattern is applied.

The adhesive pattern can cover the entire ply, or can cover only a portion of the ply. A second adhesive pattern can be present in the area not covered by the major first adhesive pattern. The first pattern and the second pattern can be different in the type of pattern, either in shape, size, or arrangement of the geometric pattern, have different coverage levels, or any combination of such features, as will be discussed below.

Figure 1:
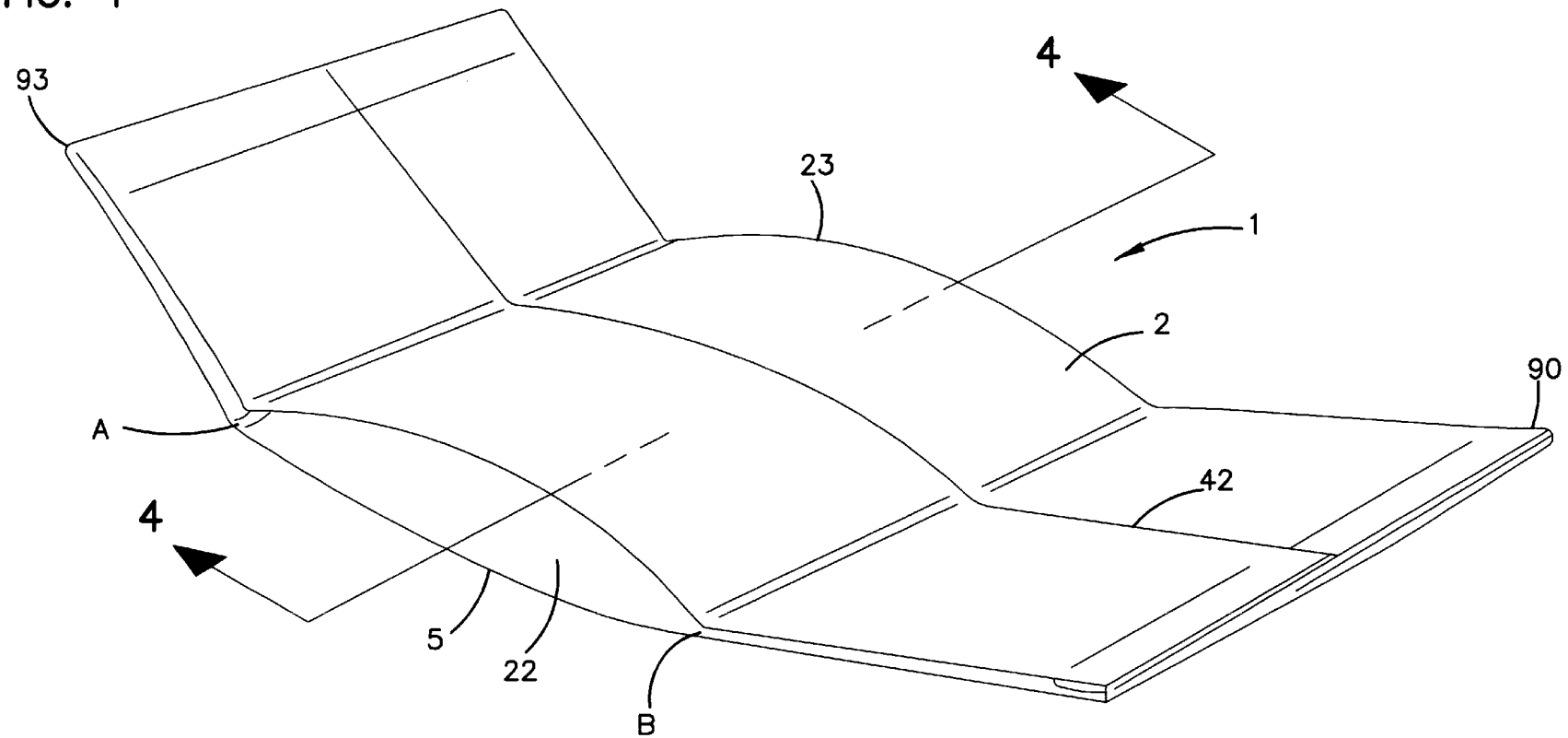
FIG. 1 is a perspective view of a microwave bag construction, according to the present invention, depicted unfolded and prior to expansion.

The reference numeral 1, in FIG. 1, generally shows a microwaveable popcorn package incorporating the various advantages according to the present invention. In FIG. 1, package 1 is shown as it generally would appear when unpacked from its protective outer wrap and positioned by a consumer in a microwave oven for use. Prior to being unpacked, packages such as package 1 are often stored in a "tri-fold" configuration, with folding being generally about fold lines A and B. In the tri-fold configuration, the package is generally stored in a protective moisture barrier outer wrap, not shown in FIG. 1. Outer wraps have been conventionally utilized for a wide variety of microwave bags.

In general, microwave popcorn package 1 comprises a flexible outer bag 2 having a charge of popcorn or popcorn and fat within its interior. During exposure to microwave energy, the popcorn is popped and the bag expands. Heating and popping of popcorn is described, for example, in U.S. Pat. Nos. 5,044,777 and 5,081,330, incorporated herein by reference. In this context, the term "flexible" is meant to refer to a package material that is not so stiff or rigid as to undesirably interfere with bag expansion during use. Alternately stated, the term "flexible" is used to refer to a material that can be readily folded and unfolded.

Figure 2:
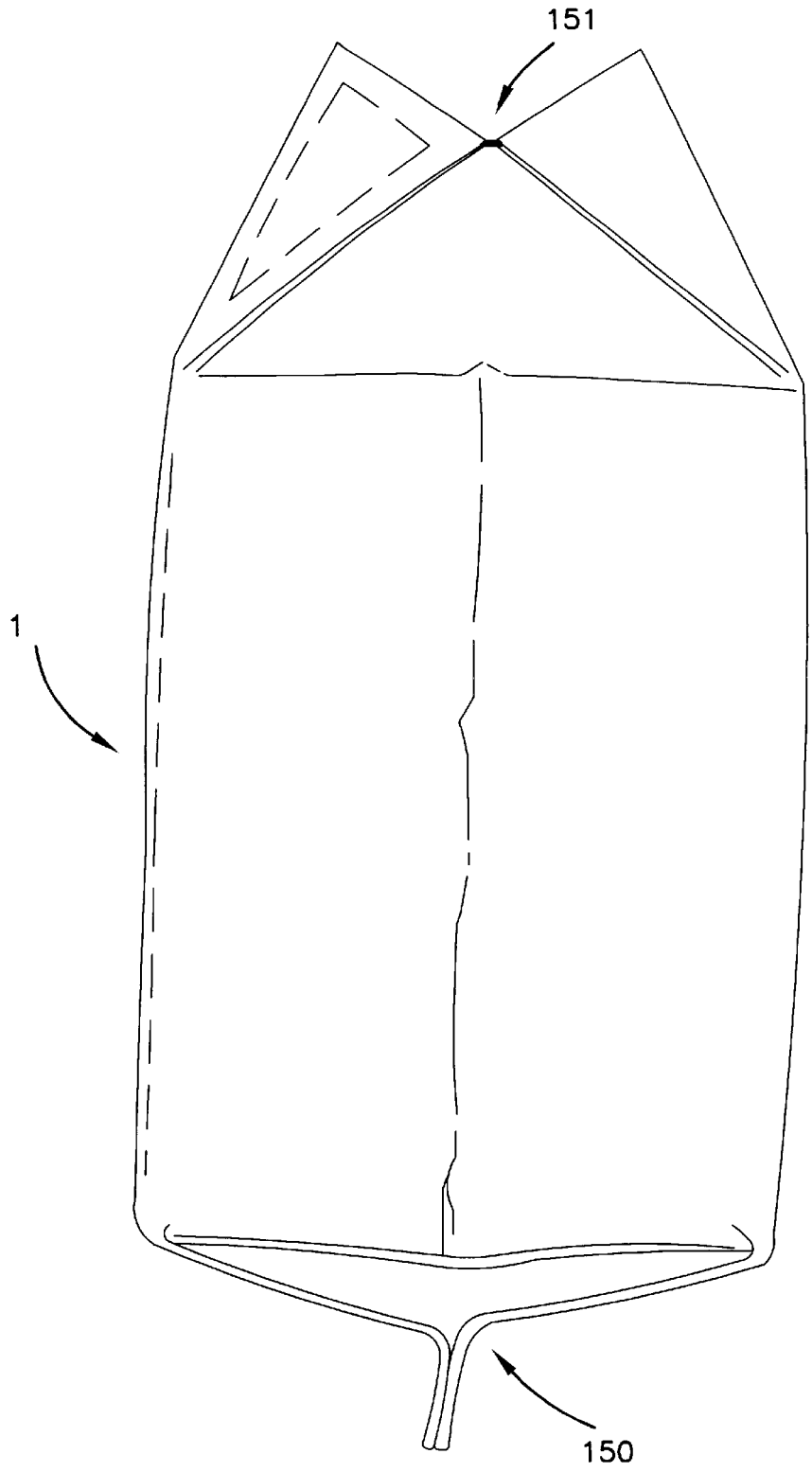
FIG. 2 is a side view of the arrangement depicted in FIG. 1, after expanding during a microwave popping operation, but depicted before it is opened to provide access to popped popcorn.
Figure 3:
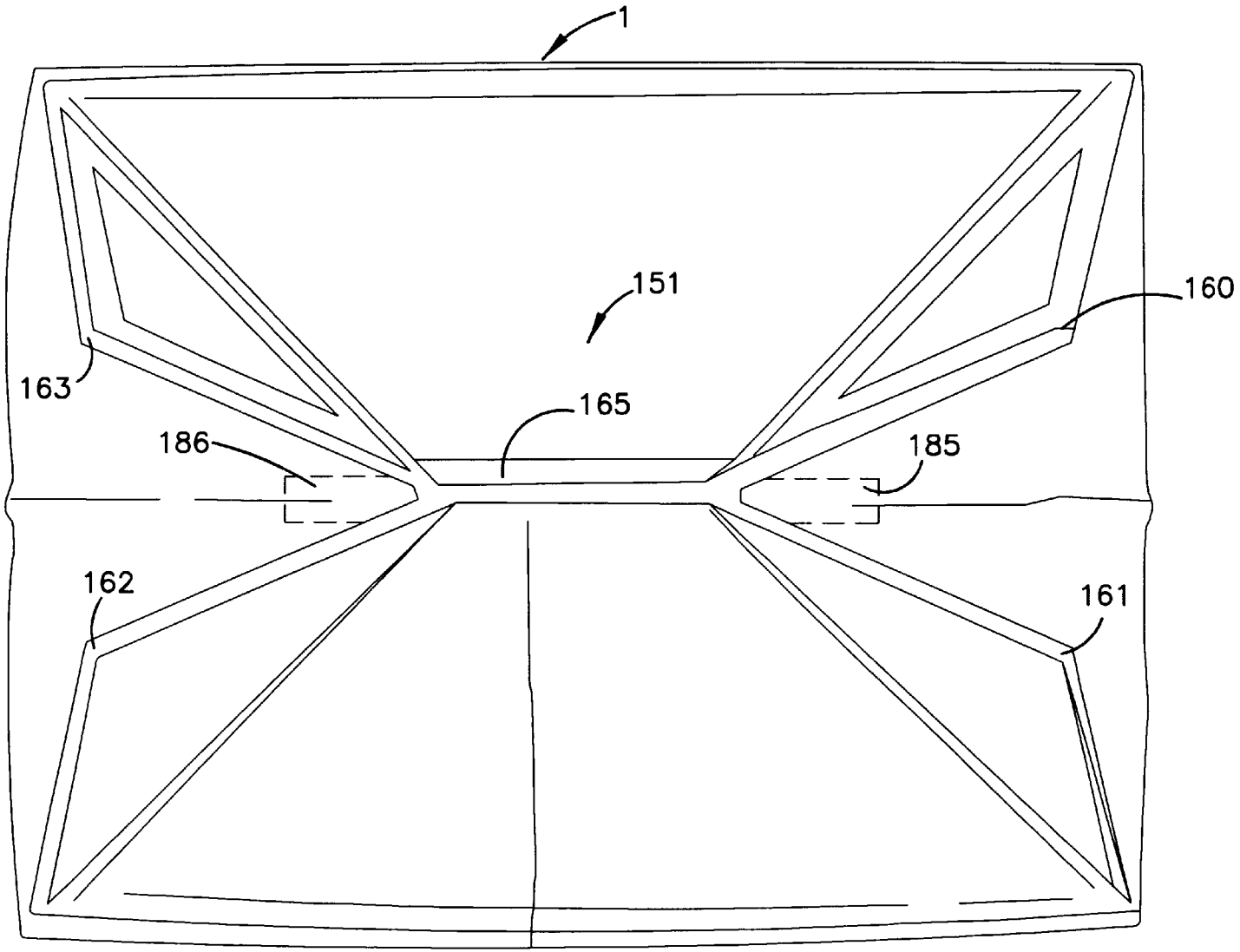
FIG. 3 is an end view of the arrangement depicted in FIG. 2.

Prior to popping, the popcorn charge is generally retained in central region 5 of bag 2. In this region, the unpopped popcorn charge is generally positioned above a microwave interactive construction. During the popping operation, moisture inside the popcorn kernels absorbs microwave energy, generating sufficient steam and heat for the popping operation. In addition, the microwave interactive construction absorbs microwave energy and dissipates heat, facilitating the popping process. In preferred constructions, the microwave interactive construction occupies central region 5, but not, to a substantial extent, other portions of the popcorn package 1. That is, microwave interactive material is preferably confined to the region where it will be in proximity with, and mostly where it will be covered by, the popcorn and oil/fat charge. FIGS. 2 and 3 show package 1 expanded after popping of the kernels.

Figure 4:
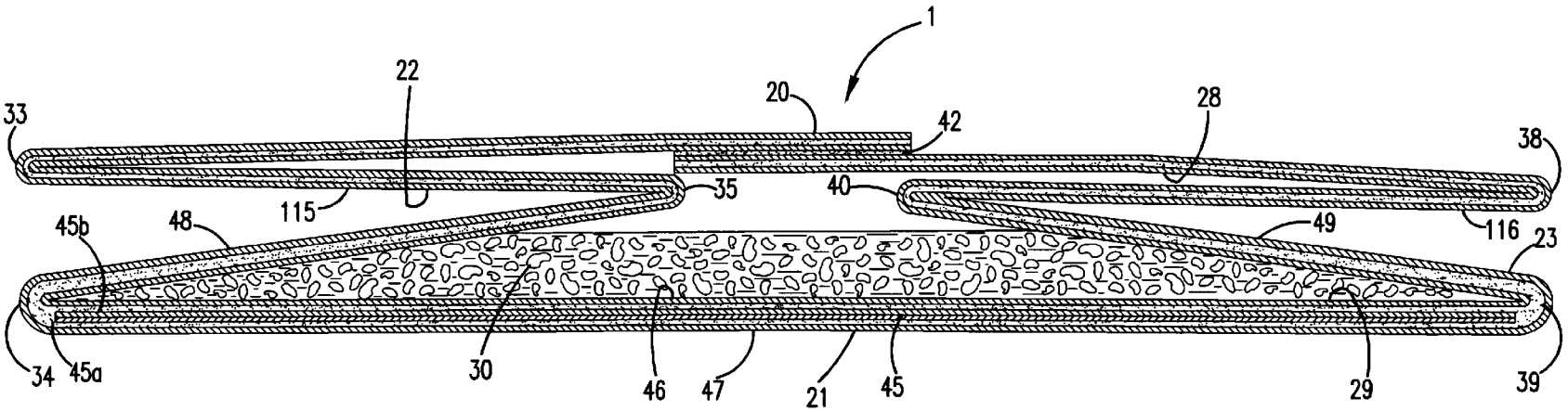
FIG. 4 is a cross-sectional view taken along line 4—4, FIG. 1.

Attention is now directed to FIG. 4, a cross-section taken generally along line 4—4 of FIG. 1. From review of FIG. 4, it will be understood that the popcorn package 1 generally has first and second opposite panels 20 and 21, joined by first and second opposite side gussets 22 and 23. Side gussets 22 and 23 generally separate popcorn package 1 into first and second expandable tubes 28 and 29. Popcorn charge 30 is initially positioned and substantially retained within one of the tubes, such as tube 29. In such cases, tube 28, prior to popping, is generally collapsed. In preferred arrangements, tube 28 is sealed closed by temporary heat seals prior to heating in the microwave oven. Still referring to FIG. 4, side gusset 22 generally has edge folds 33 and 34 and an inwardly directed central fold 35. Similarly, side gusset 23 has edge folds 38 and 39 and an inwardly directed central fold 40.

Package 1, for the arrangement shown in FIG. 4, is folded from a multi-ply (e.g., a double-ply) blank, which is typically approximately 11.625 inches by 21 inches (about 39.5×53.3 cm) in size. First panel 20 includes central longitudinal seam 42 therein. Folds such as folds 33, 34, 35, 38, 39 and 40 are widely used for flexible microwave packaging. For example, such folds are shown in U.S. Pat. Nos. 5,044,777 and 5,195,829, and products using such folds are available under the commercial designation ACT II® from Golden Valley Microwave Foods, Inc. of Edina, Minn., the assignee of the present application. Folds 33, 34, 35, 38, 39 and 40 define, inter alia, gusset panels 48 and 49.

The popcorn charge 30 includes unpopped kernels, either flavored or unflavored, which may be mixed with oil/fat. If the charge 30 has a mixture of unpopped kernels (whether flavored or not) and oil/fat, in some systems it is preferable that the oil/fat is a material that is liquefied at about 40° C. (105° F.). Generally, the weight of unpopped kernels to weight of oil/fat is preferably about 2:1 to 20:1.

Package 1 includes microwave interactive construction or susceptor 45 beneath popcorn charge 30. The microwave interactive construction 45 may be any conventional microwave interactive stock. In the particular multi-ply (two-ply) package 1 depicted, microwave interactive construction 45 is positioned between layers or plies 46, 47 of the blank. The microwave interactive construction 45 can extend past fold lines A and B, FIG. 1, or can be totally retained within area 5. In one embodiment, susceptor 45 can extend toward the openable top end 90, past fold line B about 0.4 to 1.0 inch (1 cm to 2.54 cm) and extend toward bottom end 93, i.e. past fold line A, about 0.25 to 0.5 inch (0.63 to 1.27 cm).

Attention is again directed to FIG. 4, where the microwave interactive construction 45 includes two layers; i.e., a layer of flexible microwave transparent polymeric material 45*a* and a field of microwave interactive metallic material 45*b* positioned thereon. There is no requirement that the metallic material 45*b* cover the entire surface of the polymer material 45*a*. If it is desired to have heating occur around the folds 34, 39, the microwave interactive material can be extended into these regions by extending the polymer material 45*a* and metallic material 45*b* around folds 34 and 39.

Figure 5:
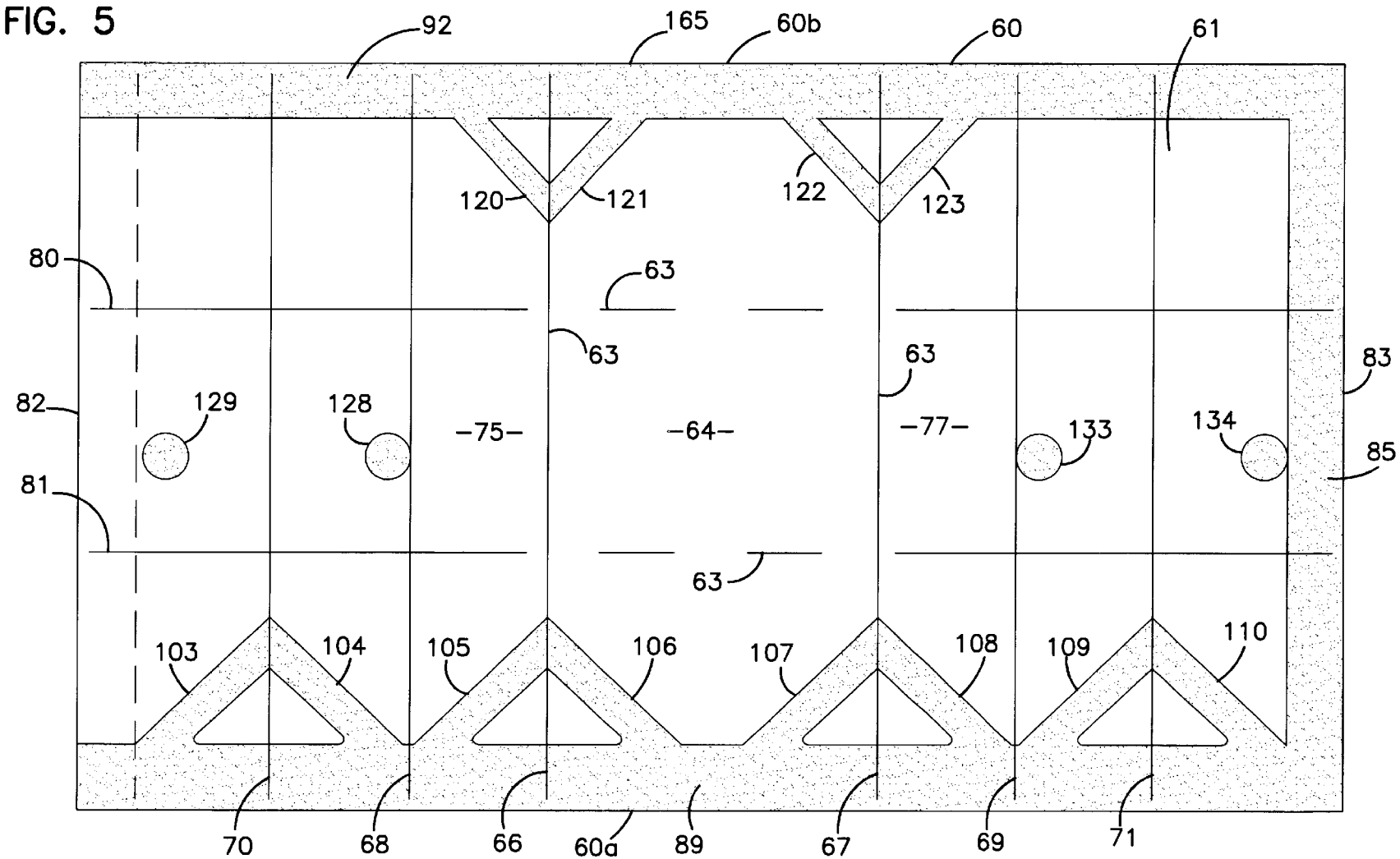
FIG. 5 is a plan view of the inside surface of a blank from which the arrangement of FIGS. 1 and 2 can be folded.
Figure 6:
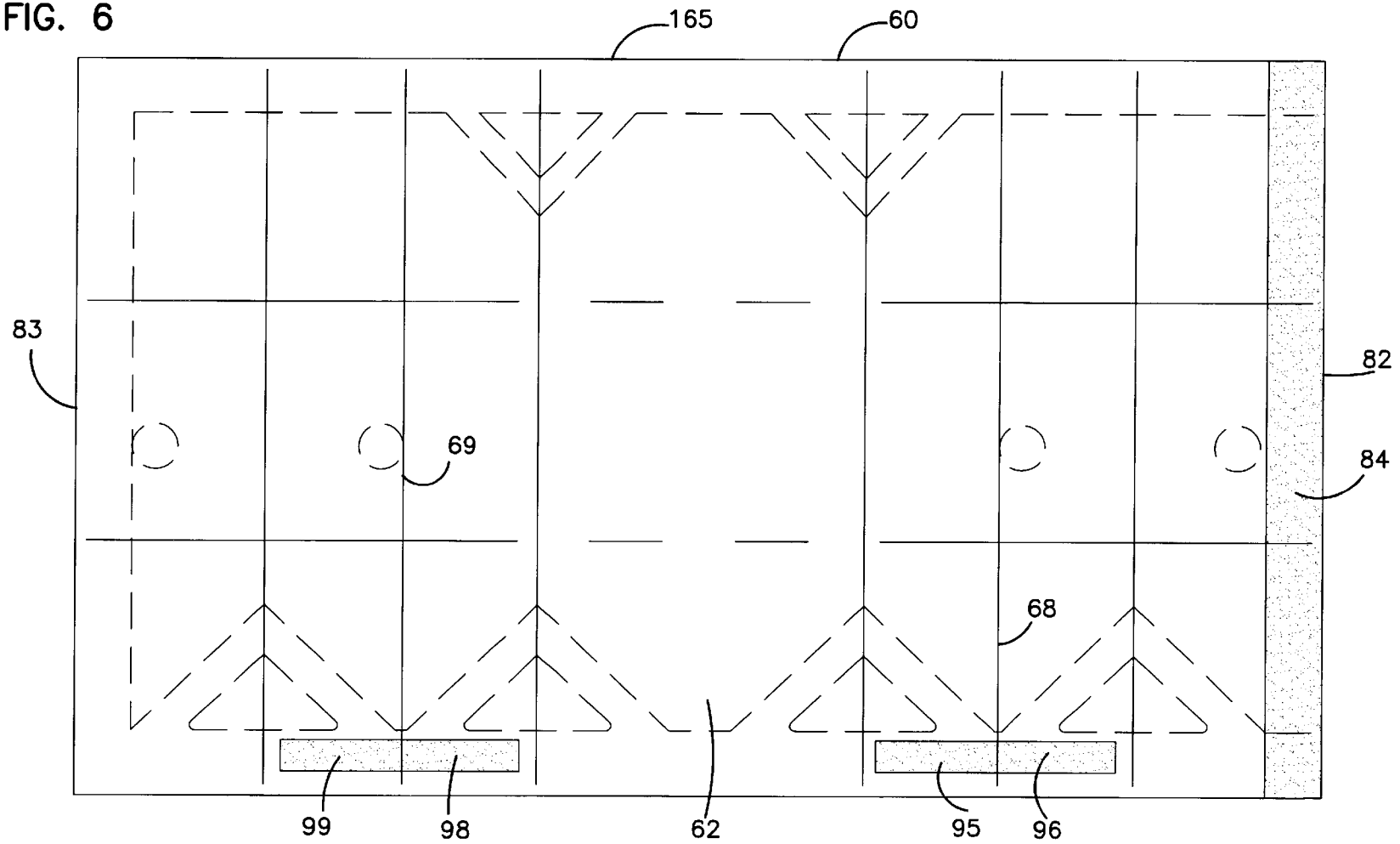
FIG. 6 is a bottom plan view of the blank shown in FIG. 3.

Attention is now directed to FIGS. 5 and 6 from which a bag arrangement according to FIGS. 1 and 2 can be folded. Many of the features illustrated in FIGS. 5 and 6 are generally known features, for example shown and described in U.S. Pat. Nos. 5,195,829 and 5,044,777. It is understood that the features illustrated in FIGS. 5 and 6 provide one example of a sealant arrangement used for constructing a bag arrangement. The sealant arrangement shown in these figures is merely one example of a sealant arrangement and is not necessarily a preferred arrangement. It is further understood that any sealant arrangement can be used without affecting the scope of the present invention, that of a geometric adhesive pattern between the first and second plies of the package.

Referring to FIG. 5, a top plan view of a panel, sheet or blank 60 is shown.

The view of FIG. 5 is of what is sometimes referred to as the "backside" or "back side" of panel 60, i.e., the side 61 of panel 60 which forms the interior surface of the assembled package 1, FIG. 1. The side opposite the side-viewable in FIG. 5, which is depicted in FIG. 6 as 62, is sometimes referred to as the "front side", and forms the exterior surface of the bag construction 1. Thus, referring to FIG. 5, panel 60 is a sheet of flexible material from which package 1 is folded, and panel 60 includes various sealant fields thereon arranged to generate desired features.

Still referring to FIG. 5, phantom line segments 63 define a region 64 with which at least a portion of a microwave interactive construction, such as susceptor construction 45, will be associated in use. The perimeter defined by phantom lines 63 also indicates a location on surface 61 where the popcorn charge will eventually be positioned. The microwave interactive construction, for example interactive construction 45, FIG. 4, may be positioned on the interior of the package 1, on the exterior, or between plies of the package.

Referring to FIG. 5, the surface 61 viewed is the surface which, when package 1 is folded, forms the interior surface of the construction. The popcorn charge 30 (shown in FIG. 4) will eventually be positioned over central region 64, which is defined by perimeter lines 63 as discussed above.

Still referring to FIG. 5, line 66 generally indicates where fold 34, FIG. 4, will be formed; and, line 67 generally indicates where fold 39, FIG. 4, will be formed. Similarly, line 68 corresponds with fold 40, line 69 with fold 35, line 70 with fold 36, and line 71 with fold 33. Thus, region 75, between fold lines 68 and 66, will eventually define panel 49, FIG. 4; and, region 77, between fold lines 67 and 69, will eventually define panel 48, FIG. 4.

Folds A and B (FIG. 1) are eventually formed by folding the overall arrangement so that folds along lines 81 and 80 are created. This folding along lines 80 and 81 will generally be done after the bag construction is assembled and filled with charge 30. Attention is now directed to FIG. 6, which is a view of panel 60, shown flipped over relative to FIG. 5. For orientation, in FIG. 6, edges 82 and 83 are opposite to FIG. 5. Sealant field 84 is used to engage field 85 (FIG. 5), during folding (with heat sealing), to form longitudinal seam or seal 42 of FIG. 4.

Referring to FIG. 5, during folding (and with heat sealing), various portions of field 89 will engage one another to form end seal 93 of FIG. 1, and various portions of field 92 will engage one another to form end seal 90 of FIG. 1. In general, end seal 90 is located at a "top end" of the construction, and is sized and configured to vent under internal steam pressure as it increases during microwave heating. Conversely, end seal 93 forms the bottom end and remains sealed during use. The consumer's typical access to the popcorn is through the "top" end at end seal 90. This is described in the '777 patent referenced above, and is discussed below in connection with FIGS. 2 and 3.

Portions of each of sealant fields 95 and 96, on an underside of panel 60, FIG. 6, will engage (overlap) one another when folded around fold line 68. This secures panel 60 in a preferred configuration after folding. Similarly, sealant fields 98 and 99, on an underside of panel 60, engage one another (with heat sealing) when the panel is folded about fold line 69.

Referring again to FIG. 5, attention is now directed to sealant fields 103, 104, 105, 106, 107, 108, 109 and 110, sometimes referred to as V-seals or diagonal seals. During folding, portions of fields 103–110 engage (overlap) one another to retain selected portions of the panel tacked to one another (with heat sealing) and to provide for a preferred configuration during expansion. In particular, during folding, field 103 engages field 104, field 105 engages field 106, field 108 engages field 107, and field 110 engages field 109. Engagement between fields 105 and 106, and also fields 108 and 107, tends to retain selected portions of panels 49 and 48 secured to panel 21, FIG. 4, in regions where the popcorn charge is not located when positioned as the collapsed folded tri-fold. Sealing of field 103 against 104, and field 110 against 109, helps retain panels 116 and 115 sealed against panel 20, FIG. 4, in the collapsed tri-fold. This helps ensure that the popcorn charge 30 is substantially retained where desired in the arrangement.

Referring again to FIG. 5, attention is now directed to sealant fields 120, 121, 122 and 123. When the arrangement is folded about fold line 66, sealant field 120 engages (overlaps) sealant field 121; and, when the arrangement is folded about fold line 67, sealant field 123 engages (overlaps) sealant field 122. The engagement (after heat sealing) between fields 120 and 121 further ensures that panel 49 will be sealed against panel 21; and, the engagement between fields 123 and 122 will further insure that panel 48 is sealed against panel 21. Fields 105, 106, 107, 108, 120, 121, 122 and 123 help ensure that the central section 5, FIG. 1, will remain relatively flat as the bag expands.

Attention is now directed to sealant fields 128, 129, 133 and 134. These are used to insure that panels 116 and 115 are sealed against panel 20, FIG. 4, so that the unpopped popcorn charge 30 is retained in tube 29 and does not substantially flow into tube 28 until desired during heating. In particular, fields 128 and 129 are oriented to engage (overlap) one another when the arrangement is folded at fold line 70; and, fields 133 and 134 are oriented to engage (overlap) one another when the arrangement is folded at fold line 71. Similarly, engagement between fields 103 and 104, and also between fields 109 and 110, ensures that tube 28 is maintained collapsed until the bag begins to expand as the steam is generated and the popcorn pops. Seals of the type associated with fields 128, 129, 133 and 134 have been used in previous constructions.

In general, the material utilized for the end seals 90, 93 and seals involving regions 103, 104, 105, 106, 107, 108, 109, 110, 120, 121, 122, 123, 128, 129, 133 and 134 is preferably a heat sealable material, activated through the use of conventional type heat sealing equipment. Sealing does not occur merely upon contact, but rather requires some application of heat, such as the heating jaws of heat sealing equipment, for activation. Such seals are preferred, in part, because it allows the seal material to be applied to rollstock using printing equipment. Thus, the rollstock can be rolled up without various layers of the arrangement becoming adhered to one another.

Attention is now directed again to FIG. 2. FIG. 2 depicts the arrangement of FIGS. 1 and 4, as it would appear after having been expanded during a microwave popping process. In general, package 1 includes opposite ends 150 and 151. End 150 is generally the end corresponding to edge 60*a* of FIG. 5, and end 151 generally corresponds to edge 60*b* of FIG. 5.

FIG. 3 is an end view looking toward end 151 of FIG. 2. As a result of the adhesive pattern depicted in FIGS. 5 and 6, the package 1 will form four tabs or ears 160, 161, 162 and 163, as shown in FIG. 3. After popping, venting will generally occur at region 165. In general, after a popping process, a consumer will open the package 1 by grasping two diagonally disposed ears, for example ears 160 and 162 or alternatively ears 161 and 163. Generally, by pulling apart the ears, package 1 is opened. While other methods may be utilized to open the package, in general this appears to be the approach utilized by typical consumers in obtaining access to popcorn popped in such arrangements. This method is convenient and avoids placing the fingers in the direct path of escaping steam/heat from the interior of the package.

Referring again to FIG. 4, in general the construction has a blank, which comprises two plies, folded appropriately to make the package 1. The panels depicted in FIGS. 5 and 6, then, preferably comprise two panels of greaseproof kraft paper of similar material. A microwave interactive construction can be included in the package, and can be positioned between the two plies. The microwave interactive construction 45 generally is a polymeric sheet 45*a* with a metal microwave interactive material 45*b,* such as a metal, deposited on at least certain portions thereof, typically on only one side. In many package constructions, microwave interactive construction 45 is positioned between the two plies and is oriented in one of two manners: either with the metal 45*b* directed toward the inside ply 46, as shown in FIG. 4, or with the metal 45*b* directed toward the outside ply 47. Typical sizes for microwave interactive construction 45 include: 5.25×6 inches (13.5×15 cm); 5.75×6.5 inches (14.6×16.5 cm); 4.25×4 inches (10.8×10.2 cm). The size of the microwave interactive construction generally depends on the size of the package involved.

Figure 7:
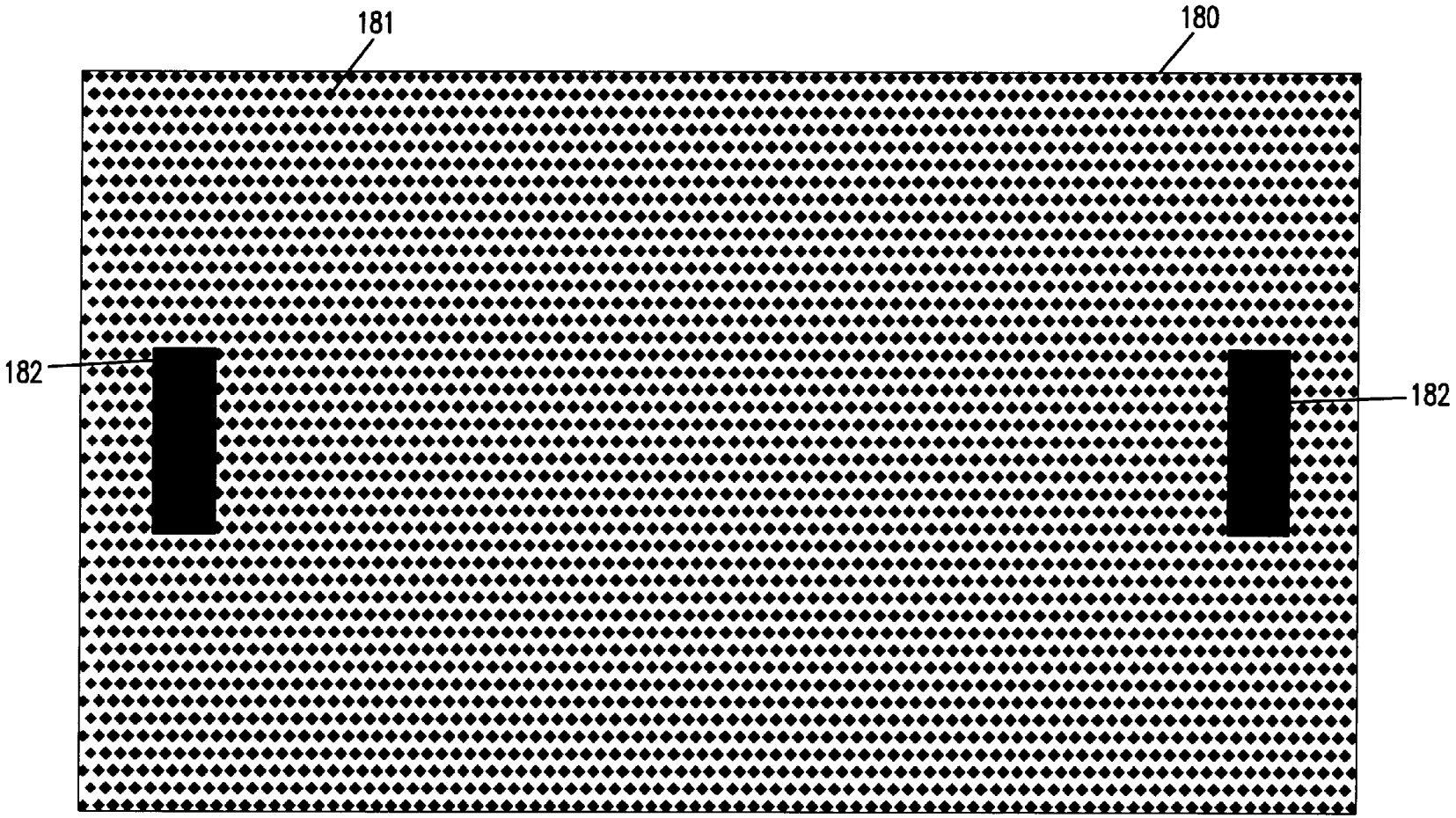
FIG. 7 is a schematic view of a glue pattern positioned between plies of the blank depicted in FIG. 5.

The present invention is directed to the geometric adhesive pattern applied between the two plies 46, 47. The pattern between the two plies 46, 47 is preferably a regular, repeating pattern of polygons. Attention is directed to the arrangement shown in FIG. 7, which shows one embodiment of an adhesive pattern. In FIG. 7, an outer ply 180 of a panel construction as shown in FIGS. 5 and 6 is depicted; this would correspond to ply 47 of FIG. 4. In FIG. 7, the darkened areas represent adhesive, which is present as an adhesive pattern on the majority of panel 180. The white areas represent portions where no adhesive is present.

The major adhesive pattern shown in FIG. 7 has a plurality of regularly spaced, solid adhesive square dots in first portion 181. The squares are tilted so that opposite corners of the square form axis on which the squares are aligned. The regular polygonal pattern occupies the majority of the surface area of outer ply 180. The adhesive pattern is present in an area of at least about 80 square inches (516 $cm^2$), generally at least 100 square inches (645 $cm^2$). Typically, the adhesive pattern is present in an area at least 150 square inches (968 $cm^2$), preferably at least 200 square inches (1290 $cm^2$). The area occupied by the adhesive pattern is the area within the perimeter of the adhesive pattern. The perimeter of the pattern is defined by the outermost edge of the outermost polygon. The area occupied by the adhesive pattern is typically a polygon itself, such as a square or rectangle, although in some instances the area is any shape imaginable. Additionally, the area occupied by the adhesive may be discontinuous; that is, the area is divided into two or more regions, or regions not having the adhesive pattern are positioned within the areas occupied by the adhesive pattern.

Typical sizes for plies on which the adhesive pattern of the present invention can be used include: 11.625 by 21 inches (29.5 by 53 cm); 9.5 by 17 inches (24 by 43 cm); 11.625 by 23 inches (29.5 by 58 cm); and 12 by 22.3125 inches (30 by 57 cm). These dimensions provide the following surfaces areas, respectively: 244 square inches (1574 $cm^2$); 161.5 square inches (1042 $cm^2$); 267 square inches (1723 $cm^2$); and 268 square inches (1729 $cm^2$). In FIG. 7, the ply has an overall area of about 244 square inches (1574 $cm^2$) and the major adhesive pattern, located in first portion 181, is present in an area of at least 200 square inches (1290 $cm^2$), specifically, the major adhesive pattern is present in an area of about 241 square inches (1555 $cm^2$).

Outer ply 180 further includes second portions 182, which occupy a small area of the surface area of outer ply 180. Second portions 182 have a solid, continuous coating of adhesive. In other embodiments, a first regular polygonal pattern is present within the first portion 181 and a second regular polygonal pattern is present in the second portion 182. It is not necessary that first portion 181 and second portion 182 occupy the areas of outer ply 180 as shown in FIG. 7. Rather, first portion 181 and second portion 182 can occupy any region of the surface. In some embodiments, the first portion 181 occupies the entire surface area of outer ply 180 so that only one adhesive pattern is present on the surface.

The adhesive geometric pattern is a plurality of polygonal shaped areas of adhesive. Examples of polygonal shapes include diamonds, squares, triangles, pentagons, hexagons, stars, circles, and the like. The polygons are filled polygons, in that at least 50% of the area defined by the perimeter of the polygon has adhesive thereon. Typically, at least 70% of the area of the polygon will have adhesive, and preferably, at least 80% of the polygon area will have adhesive thereon. Most preferably, the polygon has a solid coating of adhesive, meaning that 100% of the polygon is covered with adhesive. A combination of different shapes can be used to form a pattern. The shapes may be spaced from one another at any distance or may be connected. Spacing between adjacent adhesive areas may vary within the pattern or be constant throughout the pattern. It is understood that the tips or edges of adjacent adhesive polygons may touch and still be considered individual polygons.

The pattern of polygons can include straight lines of polygons, curved or bent lines of polygons, circles or spirals of polygons, or any such arrangement. Adjacent lines, rows, or columns of polygons may be directly aligned or may be offset as shown in FIG. 7. In the embodiment shown in FIG. 7, a first row (extending horizontally in FIG. 7) is laterally displaced from the second row displaced vertically from the first row; polygons in adjacent rows are displaced. That is, diamonds from the first row are not vertically aligned with diamonds from the second row. In alternate embodiments, the regular polygon pattern is a pattern of lines rather than discrete individual polygons. Such lines may be wavy, straight, jagged, angular, or have any other pattern. The lines may be parallel or may intersect.

The size of the polygons that form the adhesive pattern may be any size. In general, the largest diameter of the polygon, such as an axial dimension, is at least about 1 millimeter and is generally no greater than about 2.5 cm. In some embodiments, the diameter is about 2 mm to 10 mm. In some embodiments, the polygons have a side wall length of about 1 mm to 2.5 cm, preferably about 1.58 mm (0.0625 inch) to 1.27 cm (0.5 inch). In the embodiment shown in FIG. 7, the squares have sides with a length of about 3 mm (0.125 inch), providing a diameter from tip to tip of about 4.25 mm (0.17 inch).

There are various spacings associated with the polygons within the adhesive pattern. The pattern has, for example, a center-to-center measurement between polygons in the same row, between a polygon in a first row and a polygon in a second row, or between a polygon in a first row/first column and a polygon in a third row/first column. Additional measured spacings can include a tip to tip spacing between polygons in the same row, and a tip to tip spacing between polygons of adjacent rows. The spacing between adjacent polygons in the same row, that is, polygons with no other polygons positioned therebetween, is at least about 0.5 mm and is generally no greater than about 2.5 cm. In the specific embodiment shown in FIG. 7, the spacing between adjacent squares, from a tip of one square to a tip of an adjacent square in the same row, is about 1.6 mm (0.0625 inch). Generally, the spacing is about 1 mm to 10 mm, preferably 1 mm to 5 mm.

The solid square adhesive pattern shown in first portion 181, which covers about 241 square inches (1555 $cm^2$) of the ply of FIG. 7, provides a coverage of about 28% where the adhesive pattern is located; this is a 72% reduction compared to a surface that is completely covered with adhesive. The addition of the solid coating of adhesive in second portions 182 (about 3 square inches (19.4 $cm^2$) for each portion 182) elevates the total coverage of ply 180 to an overall coating level of greater than 28%.

In another embodiment, the ply surface area can be divided as a first portion, a second portion, and a third portion. The adhesive pattern may be different or the same between the first and any other portions. Examples of portions include an outer border along an outer perimeter of the ply, the area within the outer border, a microwave susceptor overlap region, and the like. Within this disclosure, the "first portion" will typically be referred to as the portion having the regular polygon adhesive pattern that occupies at least about 80 square inches (516 $cm^2$), generally at least 100 square inches (645 $cm^2$) of the ply surface. Typically, the first portion is an area at least 150 square inches (968 $cm^2$), preferably at least 200 square inches (1290 $cm^2$).

In an alternate embodiment, the ply has first and second portions, with the first portion having a major adhesive pattern provided in a regular pattern, typically diamonds or squares, and the second portion an outer adhesive border along an outer perimeter. This outer border preferably is a perimeter border having a width of 0.625 inches to 1.125 inches (1.59 to 2.86 cm). The adhesive in the second portion may be continuous or may be a pattern different than the pattern of the first portion.

In another embodiment, the first portion has an adhesive pattern provided in a regular pattern and the second portion is a microwave interactive construction overlap region having a continuous adhesive coating. The microwave interactive construction overlap region generally is 0.125 inch to 0.5 inch (0.3 cm to 1.3 cm) larger in length and width than the microwave interactive construction. The adhesive in the second portion, i.e., the microwave interactive construction overlap region, may be continuous, may be a pattern different than the pattern of the first portion, or the region may have an adhesive border with no adhesive in the center.

Preferably, no matter how many portions are present on the ply surface, the first adhesive pattern is present in an area of at least 80 square inches (516 $cm^2$), generally 100 square inches (645 $cm^2$), typically in an area of at least at least 150 square inches (968 $cm^2$), and generally 200 square inches (1290 $cm^2$). The area, or first portion, has no greater than about 50% of the surface covered with adhesive. Preferably the adhesive coverage is no greater than about 40%, more preferably no greater than about 30%. The additional portions, such as a second portion or a third portion, many have heavier or lighter adhesive coverage than the first portion having the major adhesive pattern.

As discussed, any of a variety of patterns may be used. Generally, "regular" geometric patterns will be preferred, since weak spots will be avoided. Typically and preferably, regular polygons, i.e. polygons with each side being the same length, will be preferred. The square pattern depicted in FIG. 7 is conveniently applied. It is noted that at the edges of the polygons of the pattern, fragments or partial regular polygons may result. Additionally or alternatively, the polygons may distort during application, forming different or distorted polygons. For example, the squares of FIG. 7 often may elongate, forming diamonds having one axis longer than the other axis.

In preferred arrangements, the adhesive is applied in an amount of about 5–6 lb/ream in those areas where it is positioned, although it is understood that lighter coating weights can be used. A variety of methods for application of the adhesive may be utilized, including printing methods such as flexographic printing, screen printing and gravure methods. A variety of adhesives may be utilized in arrangements according to the present invention. In general, the preferred adhesive as the laminating adhesive is Duracet 12. Indeed, the invention described is particularly well adapted for utilization with Duracet 12.

The principles according to the present invention may be utilized in an arrangement wherein the adhesive is applied to the outer ply, with the microwave interactive construction secured thereto by the polymeric surface thereof; or, in an arrangement with adhesive applied to the inner ply, with the polymeric surface of the microwave interactive construction secured thereto. Thus, in some embodiments, the adhesive pattern of FIG. 7 could be applied to the inner ply rather than the outer ply.

Processes for Preparing Preferred Constructions

Figure 8:
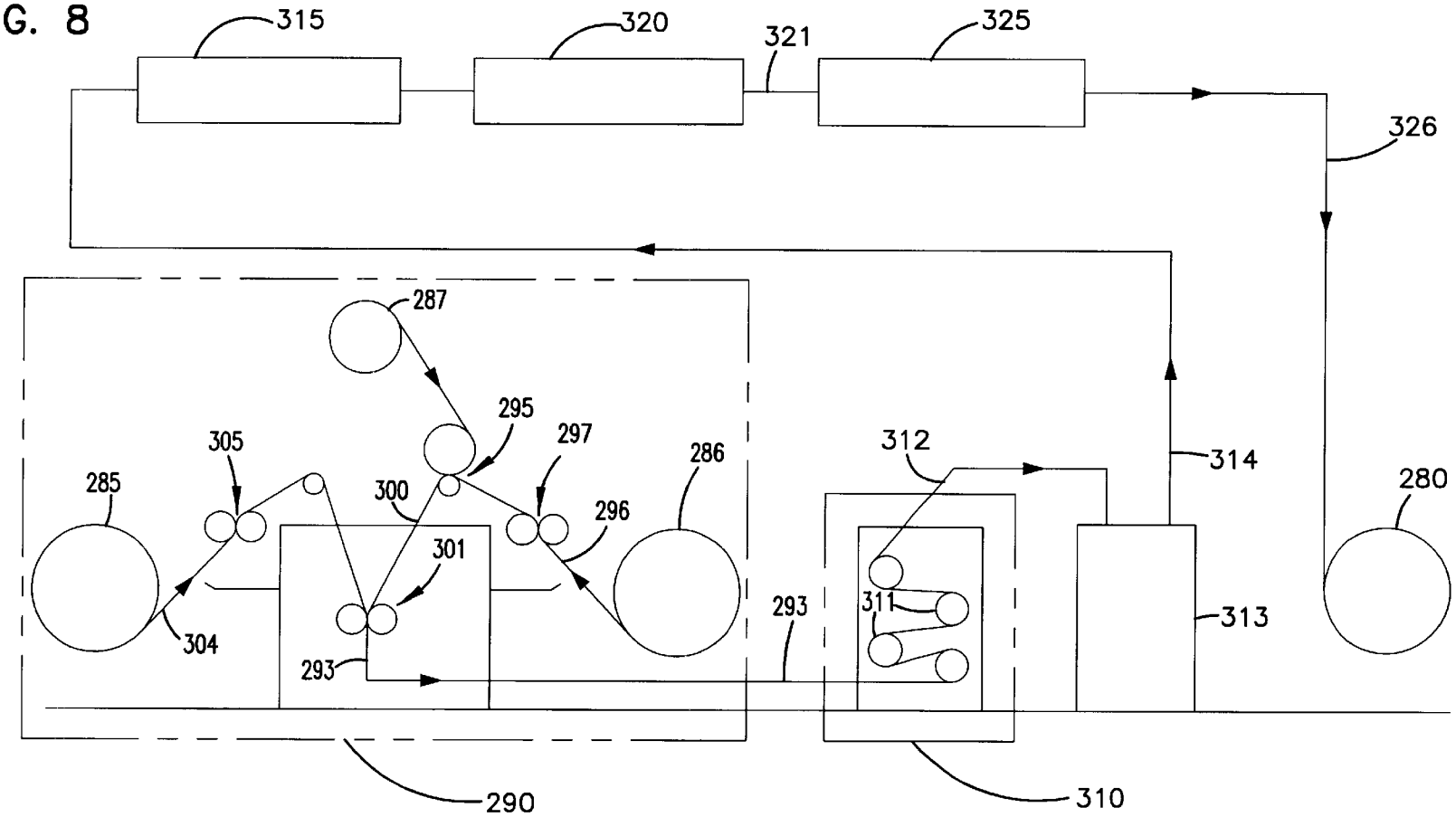
FIG. 8 is a schematic view of a process for preparing a rollstock of blanks according to FIGS. 5 and 6.

Attention is now directed to FIG. 8, which is a schematic representation for practicing certain preferred processes according to the present invention, to prepare rollstock from which advantageous microwave bag constructions can be made. It will be understood that a wide variety of techniques and methods can be used to prepare desirable rollstock. FIG. 8, and the discussion related thereto, is presented as an example of a usable technique. Many features of the operation shown in FIG. 8 are not necessarily preferred for any reason other than that they are readily made variations to a process already used to make conventional packaging.

Referring to FIG. 8, the rollstock prepared according to the schematic shown therein is a rollstock of material having two plies of paper with a microwave interactive material positioned therebetween. Thus, the rollstock prepared in the schematic of FIG. 8 could be used to prepare an arrangement such as that shown in FIGS. 1 and 4.

Referring to FIG. 8, the final rollstock material prepared according to the process is indicated generally at 280. The three feedstock materials used are indicated generally as 285, 286 and 287. Feedstock 287 includes the microwave interactive construction, pre-prepared for use in processes according to the present invention. Thus, in general, feedstock 287 would comprise continuous metallized polymeric film. In typical preferred arrangements, the metal would be deposited and positioned on only one side of the polymeric film to form the microwave interactive construction. The metal film need not cover the entire side of the polymer on which it is applied, and may be presented in a pattern.

The feedstock indicated as 286 is the material which, in the overall assembly, will form the ply corresponding to the inside ply of the bag. In certain applications described herein, it may be a kraft paper. In some applications, it may be a greaseproof paper.

Feedstock 285 generally corresponds to the material that will form the outer ply, and thus is typically a bleached kraft paper. It will eventually form the ply corresponding to ply 180 of FIG. 7. In some applications, feedstock 285 will eventually be printed, so feedstock 285 will often be a material that has a machine glazed finish. In some applications, feedstock 285 will be a material that has been treated with a fluorochemical treatment for improved grease-resistance.

In FIG. 8, phantom lines 290 identify a first stage or stage I of the process. In this stage, the various feedstocks are laminated together to form a continuous feed or web 293, fed to downstream processing. In general, referring to stage I, 290, the processes conducted are as follows. Continuous feedstock 287 of microwave interactive material is fed to station 295 simultaneously with feedstock 286. At station 295, the two are laminated to one another. In general then, at station 295, a knife blade or cutter is used to cut selected pieces of microwave interactive material from feedstock 287 for positioning on continuous paper stream 296. Conventional arrangements for cutting can be used. At station 297, paper feed 296 from feedstock 286 has applied thereto an adhesive in an appropriate location for receipt of a section of microwave interactive construction to be laminated thereon. Preferably the microwave interactive material comprises a sheet of polymeric material with a metal layer deposited on one side thereof. Preferably, the microwave interactive material is secured to web 296 with the metal layer positioned between web 296 and the polymeric sheet.

Preferably the adhesive applied at station 297 is an ethylene vinyl acetate copolymer adhesive. One commercially available example is Product No. WC-3460ZZ from H. B. Fuller of Vadnais Heights, Minn. Printing techniques such as flexographic, screen printing or gravure techniques can be used to apply this adhesive.

Still referring to stage I (reference 290), at 300 a continuous feed of paper from rollstock 286, with patches of microwave interactive construction from feedstock 287, is directed toward station 301. Simultaneously, paper stock from feedstock 285 is shown directed to station 301 as a continuous web 304. At station 305, the laminating adhesive is applied to web 304. The laminating adhesive may be applied, for example, using flexographic or gravure techniques, in a pattern according to the present invention.

At station 301, web 300, which will form a ply in the overall resulting construction, is pressed through a roller bite and is laminated in a continuous operation to web 304, which will also form a ply in the overall construction, with microwave interactive material between the paper sheets of the plies to form web 293.

At 310, a stage involving hot rollers 311 can be used, designed to facilitate drying of the adhesive. Such a stage is optional. At 312, the web is shown exiting this optional stage.

In general, it will be desired to provide printing or graphics on the outside of packages made from webs prepared according to the process. This can be conducted by directing the web 312 through a printing press (stage III), as indicated at 313. A wide variety of printing press arrangements can be used, including ones for applying multicolor printing or graphics. In general, at 314, a continuous, printed web is shown exiting the printing press 313.

In addition, in press 313, a grease-resistant treatment can optionally be applied to the surface of the web at 312, which will become the outer surface of the package; this can be done either before or after the printing. In general, the treatment can be applied by a printing press analogously to the application of any printing.

After exiting the press 313, with any desired printed indicia on the web and also any desired applied grease-resistant treatment, continuous web 314 is directed into a preliminary dryer 315. In general, the ink and the grease-resistant treatment are dried in dryer 315. Typically the dryer 315 will be a forced-air dryer system operating at about 65° to 121° C. (150° to 250° F.). The residence time in the dryer need only be sufficient to obtain a desired level of drying for the web. Typically a residence time sufficient to get a web temperature of 65° C. to 88° C. (150° F. to 190° F.) is preferred.

In typical applications, at this point it is still necessary to apply to the web the pattern of heat-seal adhesive to form the desired seals when the bag is constructed. These would generally correspond to the fields of sealant indicated in FIGS. 5 and 6. In the schematic of FIG. 8, this step is represented as conducted at station 320. The heat-seal adhesive can be applied by conventional techniques, for example, using gravure or flexographic printing.

In general, at 321, the continuous web is shown with the heat-seal fields applied thereto, being fed into a final dryer 325. In the final dryer, the heat-seal adhesive is dried and final drying of the ink occurs. In general, this can be conducted readily with a forced-air dryer system, typically set at about 121° C. to 204° C. (250° to 400° F.). At 326, the completed continuous web is shown being directed into final rollstock 280.

Processes such as those shown in FIG. 8 can be conducted to prepare printed rollstock with more than one sheet or bag oriented adjacent one another, on the final rollstock 280. This could later be split or cut to form individual streams to be fed into continuous bag-forming operations. A particularly convenient manner for orienting the printed bag blanks continuously on the webs to form a desirable rollstock 280, is with printed patterns of bags oriented side-by-side but rotationally offset by 90° (on the roller during printing). This helps ensure smooth operation of the application system, especially where the anilox transfers ink to the plates.

Figure 9:
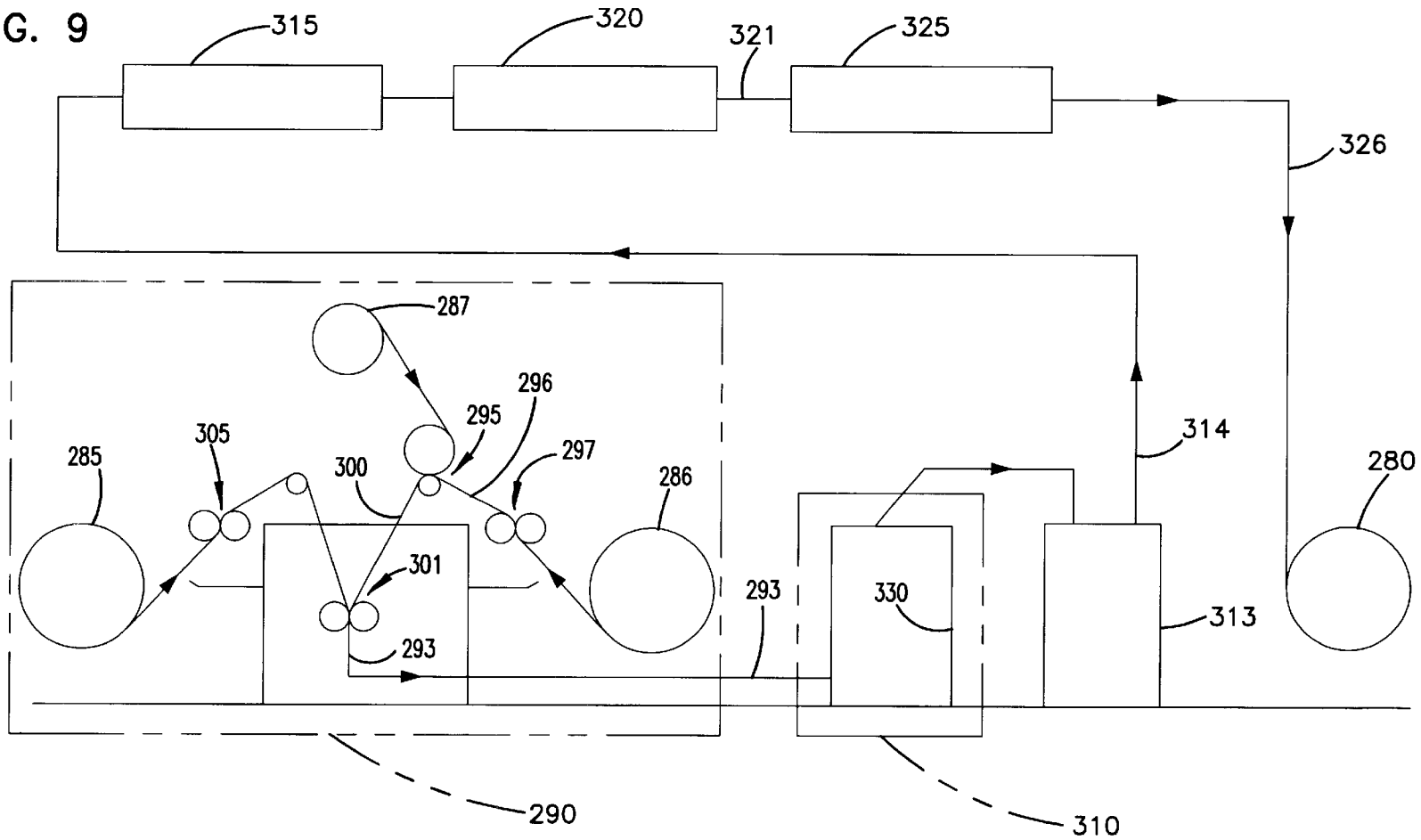
FIG. 9 is a schematic view of an alternate process for preparing a rollstock of blanks.

Attention is now directed to the schematic shown in FIG. 9. FIG. 9 is generally analogous to FIG. 8, and the same reference numerals are utilized to indicate similarly operating portions. In the arrangement of FIG. 9, as an alternative to using the optional hot roller or hot can system (as was indicated in FIG. 8 at 310) an optional forced-air drying system 330 is used. In general, it is foreseen that it would be conducted with air at about 38° to 93° C. (100° to 200° F.), depending primarily on the particular adhesive chosen and the residence time.

Preferred Materials

Preferred materials will, in general, depend upon the particular embodiment. For some embodiments, preferred materials are as follows.

For the two-ply or multi-ply arrangement of FIGS. 1–4, the preferred rollstock of microwave interactive material comprises an aluminum film vacuum deposited on 43 and 48 gauge polyester film available from Saehan of S. Korea, sufficient to give an optical density of 0.25±0.05 as measured by a Tobias densitometer. Such a material can be prepared by, and obtained from, Madico of Woburn, Mass. 01888.

For the two-ply arrangements depicted, the preferable heat sealable adhesive usable to form the heat seal pattern is a polyvinyl acetate homopolymer adhesive such as Duracet 12 available from Franklin International, Inc. of Columbus, Ohio. The seals, when such materials are used, can be formed in a conventional manner using the heated jaws of a heat sealing apparatus.

In the two-ply construction of FIGS. 1–4, the preferred adhesive for securing the metal side of the microwave interactive construction to the immediately adjacent paper ply is any conventional laminating adhesive used for microwave interactive constructions in packages. Preferred adhesives include ethylene vinyl acetate copolymer adhesives, for example Product No. WC-3460ZZ from H. B. Fuller Company of Vadnais Heights, Minn.

In the two-ply arrangement of FIGS. 1–4, when the web used for the inner ply is a greaseproof paper, the preferred web is a flexible paper material having a basis weight no greater than about 25 pounds per ream, preferably within the range of 21–25 pounds. In such instances, the paper is preferably treated with a fluorocarbon material to provide a grease-resistant character under a Scotchban® test of minimum kit 8. A usable paper is Rhinelander greaseproof RHI-PEL 250, available from Rhinelander Paper Company of Rhinelander, Wis. Details regarding the Scotchban® test are available from 3M Company, St. Paul, Minn. It is noted that in some instances a grease-resistant character to the inner paper may be desirable, in spite of the fact that what is of greater importance with respect to this paper is greaseproofness. A reason is that a grease staining of the surface of the inner sheet of paper may be viewed through the outer layer, and be unattractive to the customer. Thus, treatments of the inner layer, especially its outer surface, for grease resistance character may be preferred.

A preferred material for use as the adhesive applied in the preferred pattern, for example the pattern of FIG. 7, between the plies is Duracet 12. It is preferably applied in an amount, where printed, of about 5–6 lb/ream. It can be applied utilizing a variety of printing techniques, for example flexographic, screen printing or gravure techniques.

The foregoing description, which has been disclosed by way of the above examples and discussion, addresses embodiments of the present invention encompassing the principles of the present invention. The embodiments may be changed, modified and/or implemented using various types of arrangements. Those skilled in the art will readily recognize various modifications and changes which may be made to the present invention without strictly following the exemplary embodiments and applications illustrated and described herein, and without departing from the scope of the present invention which is set forth in the following claims.

All patents referred to herein are incorporated by reference herein in their entirety.

What is claimed is:

1. A microwave popcorn package comprising a flexible bag construction, the flexible bag construction comprising:

(a) an inner ply and an outer ply;

(b) a first pattern of adhesive positioned on a surface of one of the inner ply and the outer ply, and between the inner ply and outer ply and bonding the inner ply to the outer ply, wherein:

(i) the first pattern of adhesive occupies an area of at least 80 square inches (516 $cm^2$);

(ii) the first pattern of adhesive comprises a plurality polygons filled at least 50%; and wherein (iii) the polygons of the first pattern cover no more than 50% of the area of the first pattern.

2. A microwave popcorn package according to claim 1 wherein the polygons cover no more than 40% of the area of the first pattern.

3. A microwave popcorn package according to claim 2 wherein the polygons cover no more than 30% of the area of the first pattern.

4. A microwave popcorn package according to claim 1 wherein the polygons are filled at least 70%.

5. A microwave popcorn package according to claim 4 wherein the polygons are spaced from another a distance in a range of 0.5 mm to 2.5 cm.

6. A microwave popcorn package according to claim 4 wherein each of the polygons has a side wall length within the range of 1 mm to 2.5 cm.

7. A microwave popcorn package according to claim 1 wherein the polygons are solid.

8. A microwave popcorn package according to claim 1 wherein the first pattern of adhesive comprises a regular pattern of polygons.

9. A microwave popcorn package according to claim 1 wherein the polygons are four-sided polygons.

10. A microwave popcorn package according to claim 1 wherein the area the first pattern of adhesive occupies is at least 150 square inches (968 $cm^2$).

11. A microwave popcorn package according to claim 10 wherein the area the first pattern of adhesive occupies is at least 200 square inches (1290 $cm^2$).

12. A microwave popcorn package according to claim 1 wherein the first pattern of adhesive occupies the surface of one of the inner and the outer ply.

13. A microwave popcorn package according to claim 1 wherein the first pattern of adhesive occupies a first portion of the surface of one of the inner and the outer ply and the first pattern does not occupy a second portion of the surface.

14. A microwave popcorn package according to claim 13 wherein a second pattern of adhesive occupies the second portion.

15. A microwave popcorn package according to claim 14 wherein the second pattern of adhesive is a continuous coating of adhesive.

16. A microwave popcorn package according to claim 14 wherein the second portion is an outer border along an outer perimeter of one of the inner ply and the outer ply.

17. A microwave popcorn package according to claim 14 wherein the second portion is a central microwave interactive construction overlap region adapted to accept a microwave interactive construction.

18. A method of making a microwave popcorn package comprising the steps of:

(a) providing a first ply and a second ply;

(b) applying a first adhesive pattern on at least one of the first ply and the second ply, the first adhesive pattern:

(i) occupying an area of at least 80 square inches (516 $cm^2$);

(ii) comprising a plurality of polygons filled at least 50%, wherein the polygons cover no more than 50% of the area of the first pattern; and (c) adhering the first ply to the second ply with the first adhesive pattern positioned between the first ply and the second ply.

19. A method of making a microwave popcorn package according to claim 18 wherein the step of applying a first adhesive pattern comprises:

(a) applying a first adhesive pattern on one of the first ply and the second ply, the first adhesive pattern:

(i) occupying an area of at least 200 square inches (1290 $cm^2$).

20. A method of making a microwave popcorn package according to claim 18 wherein the step of coating a first adhesive pattern comprises:

(a) applying a first adhesive pattern on one of the first ply and the second ply, the first adhesive pattern:

(i) comprising a plurality of polygons filled at least 70%, wherein the polygons cover no more than 40% of the areas of the first pattern.

* * * * *

UNITED STATES PATENT AND TRADEMARK OFFICE

CERTIFICATE OF CORRECTION

PATENT NO. : 6,396,036 B1
DATED : May 28, 2002
INVENTOR(S) : Hanson

It is certified that error appears in the above-identified patent and that said Letters Patent is hereby corrected as shown below:

Title page,
Item [56], References Cited, U.S. PATENT DOCUMENTS,
"3,638,787" should read -- 3,638,784 --.
"4,118,813" should read -- 4,118,913 --.

Signed and Sealed this

Twenty-first Day of January, 2003

JAMES E. ROGAN
*Director of the United States Patent and Trademark Office*